US006513945B1

(12) United States Patent
Wyss et al.

(10) Patent No.: US 6,513,945 B1
(45) Date of Patent: Feb. 4, 2003

(54) DECORATIVE ILLUMINATED PUMPKIN STEMS

(76) Inventors: John Raymond Wyss, 9020 Greenwood Ave. N., Seattle, WA (US) 98103; Wade Garrett Latourette, 4715 SW. Brugger St., Portland, OR (US) 97219

( * ) Notice: Subject to any disclaimer, the term of this patent is extended or adjusted under 35 U.S.C. 154(b) by 0 days.

(21) Appl. No.: 09/905,821

(22) Filed: Jul. 16, 2001

(51) Int. Cl.[7] ..... F21K 2/06

(52) U.S. Cl. ..... 362/34; 362/84; 362/122; 362/806

(58) Field of Search ..... 362/34, 808, 122, 362/154, 191, 84, 806

(56) References Cited

U.S. PATENT DOCUMENTS

RE30,103 E * 9/1979 Spector ..... 362/34
5,091,833 A * 2/1992 Paniaguas et al. ..... 362/191
5,313,377 A * 5/1994 Kasboske ..... 362/122
5,609,409 A * 3/1997 Diehl ..... 362/101
6,065,847 A * 5/2000 Palmer et al. ..... 206/219
6,106,135 A * 8/2000 Zingale et al. ..... 361/186
2001/0036069 A1 * 11/2001 Franks ..... 362/122

* cited by examiner

*Primary Examiner*—Thomas M. Sember
*Assistant Examiner*—David V. Hobden

(57) ABSTRACT

This invention is in the area of three-dimensional holiday decorations and their manufacture, and specifically in the area of an illuminated decoration which may replace natural stems for the tops of pumpkins, squash and gourd-type fruits as used in Halloween, Thanksgiving, Harvest, Christmas and similar holiday-type decorations. An artificial replacement stem and various assorted appendages are provided. A decorative novelty item, such as a Halloween pumpkin, is affixed with said artificial stem or various appendages of a design or other festive decorative appurtenance, replacing or augmenting its natural stem. Said artificial stem or appendages may also be equipped with means of illumination, especially by chemical luminescence, together with a means for affixing said artificial stem or appendage to said pumpkin or like-type fruit such as adhesive, a spike or hook-type attachment means.

3 Claims, 2 Drawing Sheets

DECORATIVE ILLUMINATED PUMPKIN STEMS

BACKGROUND OF THE INVENTION

This invention is in the area of three-dimensional holiday decorations and their manufacture, more specifically, an illuminated decoration replacing a natural stem on the top of a pumpkin, squash or gourd-type fruit of the type used in Halloween, Thanksgiving, Harvest, Christmas and similar holiday-type decorations. Methods of creating artificial pumpkins for decoration are taught in U.S. Pat. Nos. 5,491,007 & 5,811,160, both by Chapman. The subject invention deals specifically with creation of an artificial stem, replacing a natural stem. When in transport or packing proceedures, the natural stems of pumpkins and the like can be knocked loose or off, such that when said fruits arrive at an outlet to be presented for sale, said natural stems may not be present or may be removed from a natural pumpkin or like fruit. Thus the need for an artificial stem, or a more decorative artificial stem.

In U.S. Pat. No. 5,099,604, Gallo teaches an artificial stem for flowers which acts as a feeder tube for water to reach a cut flower. That concept for an artificial stem is primarily to help a cut flower live longer, in part by capillary action, providing the cut flower with moisture. The present concept is primarily for decorative purposes, and does not aid in the life support of the cut pumpkin, squash or like fruit.

Chemically activated luminescence is very well explained in various patents, such as U.S. Pat. No. 3,576,987 by Voight, et al, a light stick device, and further in U.S. Pat. No. 5,043,851 by Kaplan, describing a polygonal design in a chemiluminescent lighting device. These devices are incorporated in the preferred embodiment of this invention. All prior art falls short of providing an easily affixed and decorative replacement stem for a pumpkin, squash or the like used at holiday times as decorative centerpieces or adornments in homes, businesses and stores. All prior art also falls short of providing a system of display upon a festive fruit by use of decorative jewel-like "warts".

SUMMARY OF THE INVENTION

It is an object of the invention to provide a replacement for missing or removed stems of the variety found naturally on the fruit of the pumpkin, squash or gourd.

It is a further object of the invention to provide a stem as mentioned in which illumination means are provided to enhance the decorative nature of the stem. It is a further object to provide various decorative stem replacements, also having means of illumination.

A further object is to provide various adorning appendages to the natural pumpkin, squash or other gourd-type fruit any of which having means for illumination. The above and other objects of the invention are achieved in the following disclosed embodiments by providing an attachable artificial replacement stem or appendage comprising a stem piece or a stem-like body which has the appearance of an actual natural stem, or may take the form of some appendage such as warts or an apparition. The said appendage may be of some type of a decorative holiday theme, an apparition or the like, or jewel-like bubbles, similar to "warts" found on certain gourd-type fruits. Said "jeweled bubbles" or "warts" are made to be easily attachable to the fruit surface, and glow by chemically luminescent means. Said artificial stem piece may be made from a choice of a wide variety of materials, for example, plastic, glass, acrylic or many other translucent, reflective or decorative-type materials.

It is a purpose to provide means of creation of a decorative lighted artificial stem constructed with the use of chemically luminescent materials, designed to be light emitting, reflecting or chemiluminescent in order to provide a festive decoration. Means for attachment to the pumpkin or the like are provided, at or about the spot where the natural stem would have protruded. The said attachment means being by either or both of an adhesive or a spike which inserts through the fruit, and once inserted is designed to hook into the natural shell of the main body of the said pumpkin or the like. It is a purpose to provide lighted "jewels" which can be affixed by similar means at any point upon the surface of the fruit, and provide decorative bumps or "warts" similar to the natural display of "warts" on a typical gourd or like-type fruit.

A purpose of the invention is to replace stems which have been broken or are missing from pumpkins or the like and the ultimate purpose is to create a replacement stem more decorative and festive than the natural stem such that even pumpkins or the like which are missing stems may made to be at least as decorative as those with the natural stem still affixed.

It is a further purpose to encourage replacement of natural stems with artificial stems, and to provide jewel-like "warts" and augmentations with the more decorative replacements provided herein, providing a more festive holiday-type decoration, pumpkin or fruit centerpiece-type decoration.

It is a further purpose to provide decorative adornments and apparitions which will enhance the decorative or holiday appearance of the natural fruits on display, and to provide those adornments with illumination such that said adornments will show and be displayed in the dark.

Those skilled in holiday design and decoration will appreciate and be able to derive a vast array of embodiments of the art after reviewing the following detailed description of the invention. The replacement "stems" with illumination and jewel-like "warts" can take a variety of shapes, sizes and forms, even to be small characters such as ghosts, witches, animals or any suitable apparition, letter or number, word or words, display, poster, sign, advertisement, message or alert signal. All of which are to be constructed in a number of known or inventive ways.

DETAILED DESCRIPTION

Figure 1:
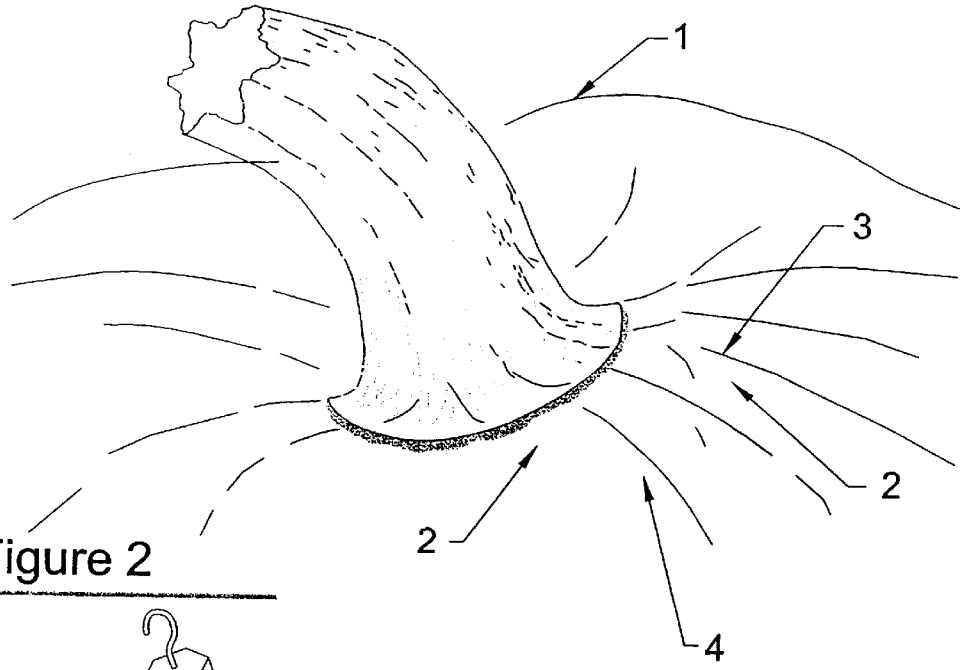
FIG. 1 Construction of Replacement Stem for Pumpkin

FIG. 1 shows a view of an artificial stem (1) prepared for attachment to a pumpkin (5). In this embodiment, adhesive (2) is applied to the proposed point of application (3) at the base of the stem, and the entire assembly would be affixed to the approximate location of the pumpkin's natural stem, (4), which is now removed. Attachment by hook shaped wire or spike is anticipated.

Figure 2:
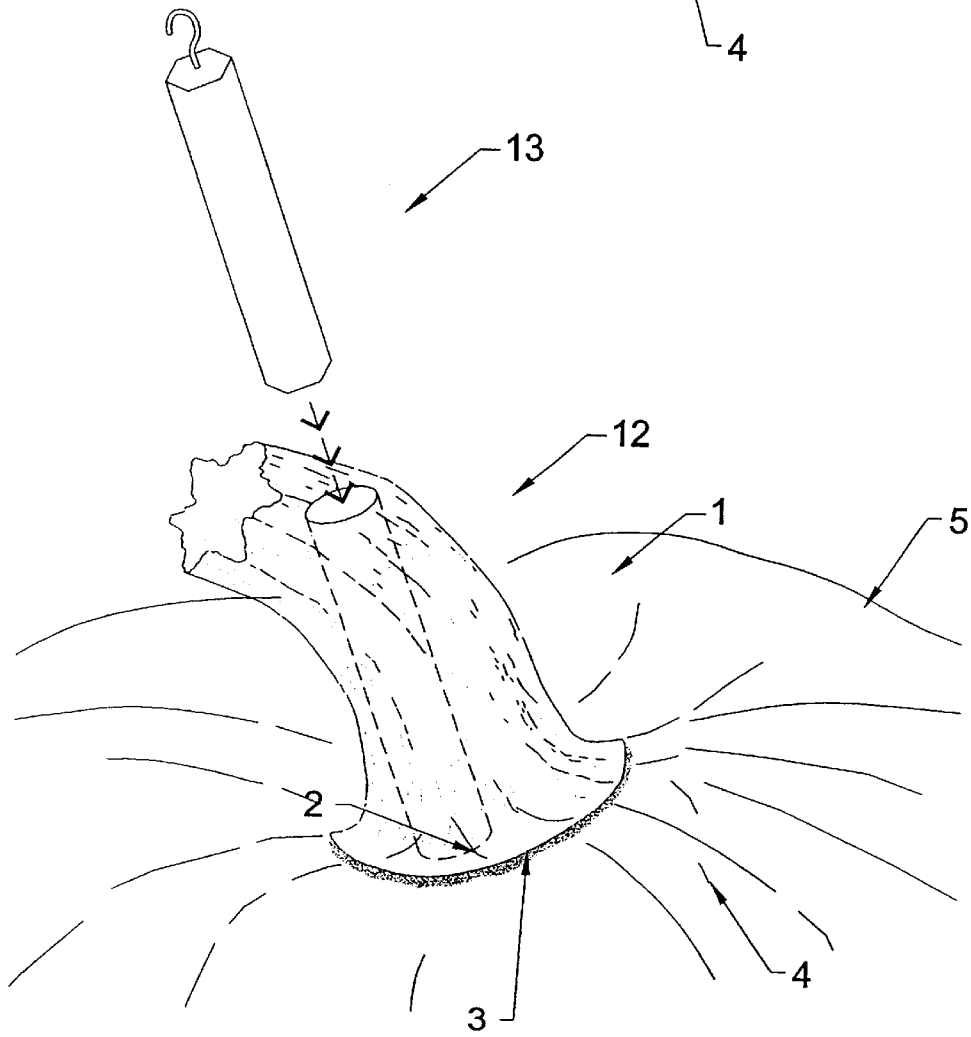
FIG. 2 Method of Illumination of Replacement Stem.

FIG. 2 shows a translucent or transparent artificial stem (1), for attachment to a pumpkin (5), which has been modified with a cavity (12), enabling the insertion of a tubular shaped chemiluminescent lighting device (13) such as the kind described in U.S. Pat. No. 5,043,851, by Kaplan, entitled "Polygonal Chemiluminescent Lighting Device". This and other patents involving chemical lighting methods are referred to for utilization herein whereby a small device known as a "light stick" is activated by a combination of two chemicals which react to temporarily generate various colors of luminescent light, thereby shining through the stem of FIG. 1, in this embodiment being formed of optically transparent or translucent material, and thence illuminating said artificial stem by virtue of being inserted into a provided cavity therein, which will accept and contain said "light stick" lighting device. The entire assembly is affixed by adhesive (2) to its proposed point of application (3) at the base of the artificial stem, for its proposed attachment to the approximate location of the pumpkin's natural stem, (4), which is now removed. Attachment by hook shaped wire or spike is anticipated, as described above in FIG. 1.

Figure 3:
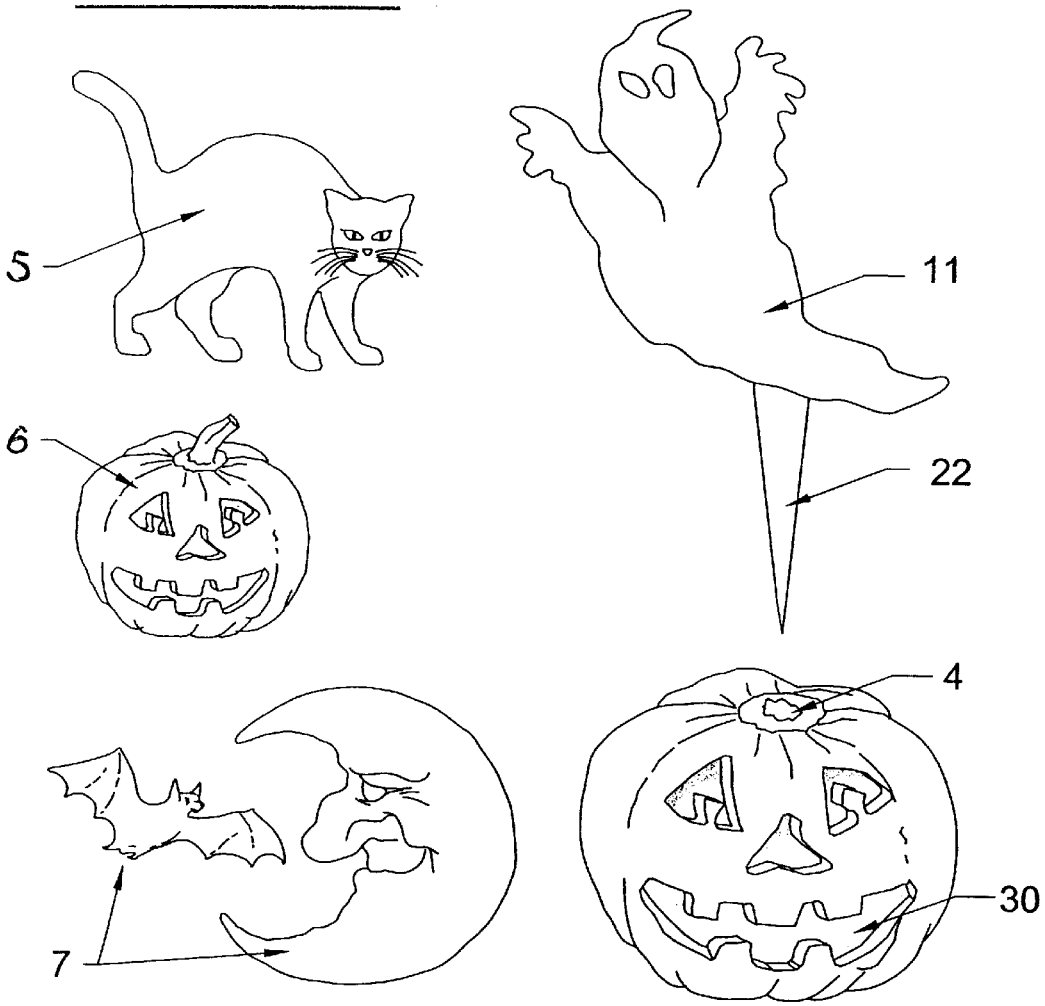
FIG. 3 Decorative Appendages with Illumination Means

FIG. 3 shows a decorative stem replacement in the form of a ghostly apparition, (11), formed of an optically transparent glass or acrylic, with attachment means by extension of a pointed base (22) into a pumpkin's (5) hollow center or interior (30). This embodiment with a pointed base is shown as it may be attached to the pumpkin. The replacement stem, (11), made of a translucent or semi-transparent optical material tends to emit light at its remote edges which is picked up from any source which may be located within the interior volume space, (30), such as a candle, light bulb or the like, and cast a reflective glow outwardly from the said decorative stem replacement's upper portion (11). If this stem replacement contains chemiluminescent lighting means then light emission is by that source and the stem replacement affixes to the pumpkin surface at the approximate location of the pumpkin's natural stem, (4), which is now removed. Attachment by hook shaped wire or spike is anticipated, as in FIG. 1.

Alongside are other various holiday designs, a cat (6), a baby pumpkin (7), a bat and a moon (8), any or all of which can lend designs to such a purpose and decorate the fruit. Even a sign with words, numbers, symbols or messages can be displayed in this manner, as said replacement stem, and such use is anticipated.

Figure 4:
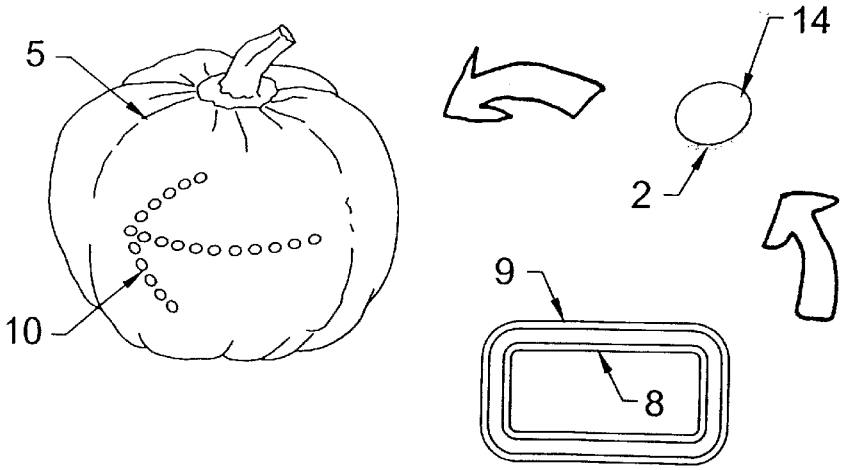
FIG. 4 Decorative Jewel-like "Warts" with Illumination Means

FIG. 4 shows a view of a jewel-like appendage (14), said appendage to be attached to said pumpkin or the like (5) by affixing means, adhesive (2), and displayed as adornments or decorative "warts". Said jewel-like appendage may be made of a vessel (8) within a vessel (9), wherein the inner vessel, being breakable, contains a first reactive chemiluminescent agent, which in combination with the contents of the outer vessel, containing a second reactive chemiluminescent chemical, causes a light-emitting effect, for decorative, lighting or informational purposes, when placed or affixed onto the exterior of said fruit surface. These appendages, if small, can be arranged to form arrows or words which relay data or information to party goers or the like, as the display of small glowing jewels here is arranged to form a directional arrow (10).

What is claimed is:

1. A decorative illuminated pumpkin assembly comprising:

a pumpkin stem having an upper portion and a lower portion, said upper portion having an aperture and a cavity therein for insertion of a chemiluminescent light stick, said lower portion having an attachment means for attaching the stem to the pumpkin whereby said light stick illuminates said stem.

2. A decorative illuminated pumpkin assembly of claim 1, wherein said stem is transparent or translucent.

3. A decorative illuminated pumpkin assembly of claim 2, wherein said stem is acrylic or glass.

* * * * *